US005141189A

United States Patent [19]

Andrew

[11] Patent Number: 5,141,189

[45] Date of Patent: Aug. 25, 1992

[54] CURLING IRON HOLDER

[76] Inventor: David R. Andrew, 5203 Villa del Mar 317, Arlington, Tex. 76017

[21] Appl. No.: 697,233

[22] Filed: May 6, 1991

[51] Int. Cl.[5] ..... A47G 23/02

[52] U.S. Cl. ..... 248/154; D28/38; 211/70.6; 248/117.4; 248/117.6; 248/117.7; 248/231.8

[58] Field of Search ..... 248/146, 154, 229, 231.8, 248/316.7, 117.1, 117.4, 117.2, 117.3, 117.6, 117.5, 117.7, 113, 37.6; 211/70.6, 26; 132/112, 232; 126/409, 408; D28/38, 79

[56] References Cited

U.S. PATENT DOCUMENTS

| | | | |
|---|---|---|---|
| 1,616,721 | 2/1927 | Vallin | 248/117.3 |
| 2,527,435 | 10/1950 | Little et al. | 248/177.7 X |
| 2,528,846 | 11/1950 | Sitnick et al. | 248/117.4 |
| 4,159,773 | 7/1979 | Losenno | 248/117.1 X |
| 4,762,979 | 8/1988 | Geoffroi | 248/117.1 X |

*Primary Examiner*—Ramon O. Ramirez

[57] ABSTRACT

A device for holding a curling iron, during and after use, in a safe environment, which comprises base members, resilient clip, and protective heat shield, where the base members provide a means for mounting the device and supports the clip and protective heat shield, the clip firmly grips the curling iron handle, and the protective heat shield surrounds the curling iron barrel, preventing accidental contact with the heated barrel.

1 Claim, 1 Drawing Sheet

CURLING IRON HOLDER

BACKGROUND OF THE INVENTION

1. Field of the Invention

The invention relates generally to a device for holding a heated curling iron about its longitudinal axis in a safe environment.

2. Description of the Related Art

Conventional curling irons are manufactured with a pivotal support leg or utilize a stand to rest the curling iron on a horizontal surface, during and after use, such that the curling iron barrel does not contact the resting surface. The above-described conventional rest is subject to several shortcomings. In the first place, the conventional rest does not isolate the heated curling iron barrel from the surrounding environment. Moreover, since the conventional rest does not secure the curling iron, the curling iron can easily slide or be pulled from the resting surface. Thus, a potentially hazardous situation exits should the heated curling iron barrel inadvertently contact the user or ignite an object in the area. In addition to the foregoing, the curling iron cannot be stored until the curling iron barrel has cooled sufficiently, thus giving an untidy appearance.

Constructions for the purpose of holding a heated curling iron have been targeted for professional use, as shown in U.S. Pat. No. 4,159,773. In such an arrangement the curling iron is held securely about the heated barrel of the curling iron. The above-described holder is subject to several shortcomings. Because the curling iron is held about the heated portion of the curling iron, there is a potential for the arrangement to become heated. Moreover, such an arrangement does not isolate the heated barrel from accidental contact. In addition to the foregoing, such an arrangement is cumbersome, and does not alleviate the problem of an unslightly appearance.

The present invention overcomes all of the above-mentioned shortcomings by providing a holder of a streamlined construction, wherein a curling iron is held securely in a safe environment.

SUMMARY OF THE INVENTION

The invention is a device to allow a curling iron, during and after use, to be held about its longitudinal axis in a safe environment. It comprises a means for mounting the invention on a wall, inside a cabinet or a drawer; a resilient clip for gripping the curling iron handle; and a protective heat shield designed to safeguard against accidental contact with the heated curling iron barrel.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

Referring now to the drawing in detail, wherein like numerals indicate like elements, there is seen in FIG. 1 a curling iron holder designated generally by the reference numeral 10.

Figure 1:
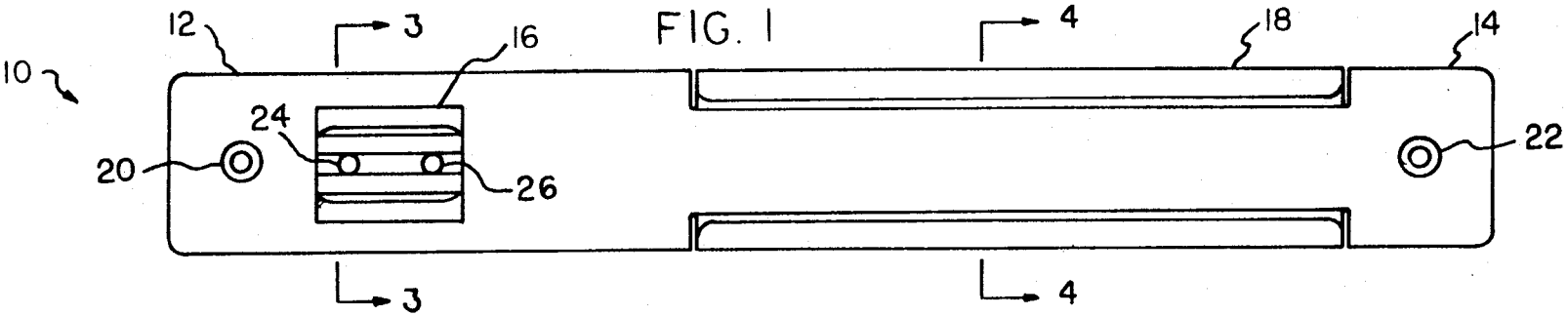
FIG. 1 is a plan view of a curling iron holder in accordance with the invention.

The curling iron holder 10 includes base members designated generally by the numeral 12 and 14. The base member support a resilient clip 16 and protective heat shield 18. The base members are constructed of a metallic sheet material shaped as to form a foot pad, which can be mounted to a wall, inside a cabinet or drawer by fasteners 20 and 22.

Also, in a preferred embodiment, as is apparent from FIG. 1, the resilient clip 16 is attached to the upper surface of the base member 12 by fasteners 24 and 26, or by other fastening methods such as staking.

Figure 2:
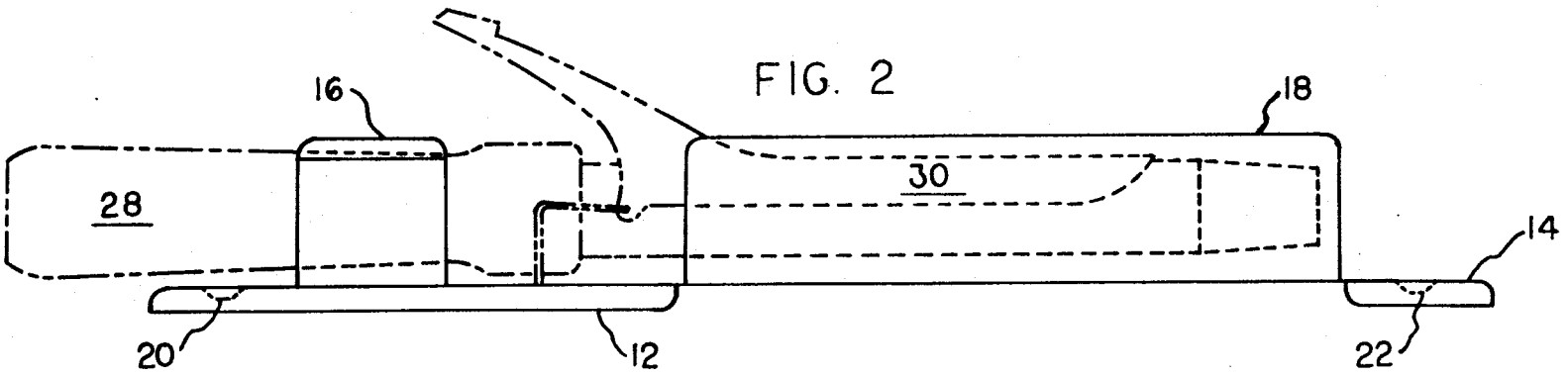
FIG. 2 is a side elevation view of a curling iron holder in accordance with the invention, showing a curling iron in place thereon.
Figure 3:
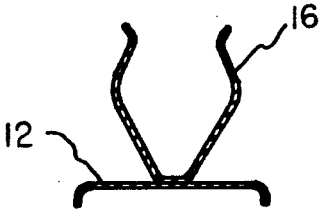
FIG. 3 is a sectional view, along Section 3—3 of FIG. 1.

As best seen in FIG. 2, the resilient clip 16 enables the curling iron 28 to be gripped in a cantilevered position about its longitudinal axis such that the heated barrel 30 of the curling iron 28 does not contact the base members or protective heat shield, thus to provide a thermally insulating air medium around the heated barrel 30. Referring to FIG. 3, the resilient clip may be constructed of metallic or plastic material and comprises a body shell in the form of a partial sleeve.

Figure 4:
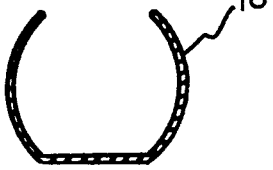
FIG. 4 is a sectional view, along Section 4—4 of FIG. 1.

Referring to FIGS. 1 and 4, the protective heat shield 18 is constructed of a metallic partial sleeve, which serves to protect the heated barrel 30 of the curling iron 28 from the surrounding environment. Referring to FIGS. 2 and 3, the protective heat shield 18 and the base members 12 and 14 are thermally insulated from the mounting surface by a medium of air. Also in the preferred form of the invention, the transfer from the protective heat shield 18 to base members 12 and 14 is retarded by a reduced conduction path to such an extent that the mounting surface, is not heated by the barrel 30 of the curling iron 28.

The present invention may be embodied in other specific forms without departing from the spirit or essential attributes thereof and, accordingly, reference should be made to the appended claims, rather than to the foregoing specifications as indicating the scope of the invention.

I claim:

1. A device for holding a curling iron having a handle and a heat barrel; said device comprising base members having an upper mounting surface supporting a resilient clip and a protective heat shield in spaced side by side relation; said resilient clip means having the shape of a partial sleeve for gripping the curling iron handle firmly about its longitudinal axis, preventing any axially or rotationally movement and also holding the curling iron in a cantilevered position wherein the heated barrel of the curling iron stands away from said base members and said protective heat shield to thus provide a thermally insulated air medium around the heated barrel; said protective heat shield means having the shape of a partial elongated sleeve for isolating the heated barrel, and preventing the barrel from contact with the surrounding environment, and also connected to said base members so that the said protective heat shield is spaced from the mounting surface to thus provide a thermally insulated air barrier therebetween and so that heat transfer from said protective heat shield to said base members is retarded by a reduced conduction path.

* * * * *